US006244839B1

(12) United States Patent
Cole et al.

(10) Patent No.: US 6,244,839 B1
(45) Date of Patent: Jun. 12, 2001

(54) PRESSURE COMPENSATED VARIABLE DISPLACEMENT INTERNAL GEAR PUMPS

(75) Inventors: Jack H. Cole, Fayetteville, AR (US); Yong Fong Tay, Johor (MA)

(73) Assignee: University of Arkansas, Little Rock, AR (US)

( * ) Notice: Subject to any disclaimer, the term of this patent is extended or adjusted under 35 U.S.C. 154(b) by 0 days.

(21) Appl. No.: 09/191,595

(22) Filed: Nov. 13, 1998

Related U.S. Application Data

(60) Provisional application No. 60/065,708, filed on Nov. 14, 1997.

(51) Int. Cl.[7] ..... F01C 21/16
(52) U.S. Cl. ..... 418/21; 418/171
(58) Field of Search ..... 418/21, 166, 171, 418/168

(56) References Cited

U.S. PATENT DOCUMENTS

| | | | | |
|---|---|---|---|---|
| 1,486,682 | * | 3/1924 | Phillops | 418/168 |
| 1,990,750 | * | 2/1935 | Pigott | 418/21 |
| 2,331,127 | * | 10/1943 | MacNeil | 418/21 |
| 2,484,789 | * | 10/1949 | Hill et al. | 418/21 |
| 4,097,204 | | 6/1978 | Palmer | 418/19 |
| 4,413,960 | | 11/1983 | Specht | 418/19 |
| 4,492,539 | | 1/1985 | Specht | 418/19 |
| 4,740,142 | * | 4/1988 | Rohs et al. | 418/21 |
| 4,812,111 | * | 3/1989 | Thomas | 418/21 |
| 4,872,536 | * | 10/1989 | Yve | 418/21 |
| 5,476,374 | | 12/1995 | Langreck | 418/171 |

FOREIGN PATENT DOCUMENTS

| | | | | |
|---|---|---|---|---|
| 862094 | * | 1/1953 | (DE) | 418/21 |
| 859793 | * | 1/1961 | (GB) | 418/21 |
| 56-20788 | * | 2/1981 | (JP) | 418/21 |

* cited by examiner

*Primary Examiner*—John J. Vrablik
(74) *Attorney, Agent, or Firm*—Head, Johnson & Kachigian

(57) ABSTRACT

The pump has a fixed gear axis eccentricity and varies displacement by moving controlling elements linearly along the drive shaft. A pressure compensator may be employed to displace the controlling elements. The pump includes a housing penetrated by a drive shaft rotating internal elements. The internal components slide along the longitudinal axis established by the drive shaft to vary the fluid displacement of the pump. The axially-moving elements include the drive shaft, inner gerotor element, port plug, thrust bearing and retainer sleeve. The drive shaft includes an internal flanged forming a piston. The outward face of the piston is in contact with fluid at system pressure. The internal gerotor element and port plug are retained against the piston by a thrust bearing that slides over the drive shaft and is held in place by a retainer sleeve. The port plug has a rear face that also functions as a piston and this face is the same size as the flanged piston. Thus, the outward piston face and rear face of the port plug can push the assembly in the housing along the longitudinal axis established by the driveshaft. A pressure compensator senses the system pressure and then displaces the axially-moving elements to produce the required displacement. The compensator is controlled by pressure operating against a return spring. The pressure compensator may either be external or integral with the pump.

7 Claims, 17 Drawing Sheets

$G_p = N_p \times (D_p/x_{max})$ where $N_p$ is the speed of pump $D_p$ is the volumetric displacement $x_{max}$ is the maximum piston displacement

PRESSURE COMPENSATED VARIABLE DISPLACEMENT INTERNAL GEAR PUMPS

CROSS REFERENCE TO RELATED APPLICATION

This application is a continuation of U.S. patent application Ser. No. 60/065,708 entitled Pressure Compensated Variable Displacement Internal Gear Pumps filed on Nov. 14, 1997.

BACKGROUND OF THE INVENTION

BACKGROUND OF THE INVENTION

The present invention relates generally to variable displacement gear pumps. More particularly, the present invention relates to a variable displacement internal gear pump with pressure compensation.

As will be appreciated by those skilled in the art, fixed displacement gear pumps are widely used because they are simple, rugged, compact, and relatively inexpensive. However, constant pressure systems that use such pumps waste energy by exhausting excess flow at system pressure through relief valves. If gear pumps can be economically made into variable displacement forms, they can be used to make constant pressure systems more efficient.

Gear pumps are made in both external and internal configurations. Internal gear pumps are of two types, internal spur gear or gerotor. Internal spur gear pumps use a crescent shaped member in the space in between the inner and outer gear teeth while gerotor pumps have a tooth profile which does not require a crescent member. The gerotor mechanism is made up of inner and outer toothed elements. The internal toothed element has one less tooth than does the outer element and the outer element uses a conjugate tooth profile. As a result, the inner and outer tooth profiles maintain continuous fluid tight contact during operation.

Designing a pressure compensated variable displacement gear pump is a challenging problem that several engineers have attempted to solve. Most designs involve internal gear arrangements. During the last twenty years, several patents have been issued on such concepts. For example, U.S. Pat. No. 5,476,374, issued to Langeck on Dec. 19, 1995, describes an axially-ported variable volume gerotor pump configuration. In that invention, variable flow control is achieved by returning part of the output flow to the pump inlet. U.S. Pat. No. 4,492,539, issued to Specht on Jan. 8, 1985, shows a variable displacement gerotor pump. The described design varies the eccentric position of an outer member relative to an inner member by rotating position control members. Another patent by Specht, U.S. Pat. No. 4,413,960, issued Nov. 8, 1983, describes a position controlled device for a variable delivery pump. In this patent, the pump body can be rotated through an infinite range of angles relative to the pump housing to regulate the eccentric position of pumping elements. This action controls the volume output of the pump.

Another internal gear pump is shown in U.S. Pat. No. 4,097,204, issued to Palmer on Jun. 27, 1978. The Palmer patent shows a variable displacement gear pump which uses a radial movement of the external gear axis to form an eccentric with the internal gear to vary the volume of fluid displaced by the pump.

While the known art shows variable displacement pump forms that may be physically realized, their complexities make practical commercialization unrealistic. Thus, known art fails to address the need for an improved pressure compensated variable displacement internal gear pump. In particular, the known art fails to provide an internal gear pump using variable displacement that is fast-acting. An improved internal gear pump should quickly respond to changing displacement requirements to improve overall pump efficiency.

SUMMARY OF THE INVENTION

The present invention addresses the problems associated with the known art. The present invention is based upon research begun by Dr. Cole concerning internal gear pump design that has been continued and broadened to include pressure compensation for variably displacing the internal gear pump. The resulting variable displacement gerotor pump has a fixed gear axis eccentricity and varies displacement by moving controlling elements linearly along the drive shaft. The improved pump is very responsive to changing displacement requirements.

In an exemplary embodiment, the internal gear pump includes a housing accepting fluids to be pumped and emitting pumped fluids. The housing is penetrated by an elongated drive shaft that is preferably driven by an associated motor or the like. The drive shaft extends into the housing where it rotates internal elements to pump the fluids into and out of the housing.

In the exemplary embodiment, the gear pump includes several internal components that slide along the longitudinal axis of the drive shaft to vary the fluid displacement of the pump. The axially-moving element assembly includes the drive shaft, inner gerotor element, port plug, thrust bearing and retainer sleeve. The inner gerotor element is keyed to the drive shaft and, except for the port plug, the axially-moving element assembly rotates as a unit. Of course, this assembly is driven by the drive shaft.

A coupling with a hexagonal cross-section or other shape of male spline is formed at the driven end of the drive shaft with a corresponding coupling formed in the end of the prime mover shaft from the motor. This allows torque to be transmitted to the drive shaft while facilitating simultaneous axial motion of the drive shaft with respect to the drive coupling. Minimum engagement length in the coupling assures that torque can be continuously transmitted when the drive shaft slides axially in response to pressure deviations, as will be discussed in detail hereinafter.

The driven end of the shaft includes an integral flanged piston disposed inside the pump housing that also serves to axially retain the internal gerotor element and port plug. The outside diameter of the piston is only slightly smaller than the inside diameter of the bore in which it slides. The outward face of the piston is in contact with fluid that is nominally at system pressure.

The internal gerotor element and port plug are retained by a thrust bearing that slides over the drive shaft and is held in place by a retainer sleeve that securely attaches to one end of the drive shaft. The inner face of the thrust bearing contacts the inner periphery of the rear face of the port plug and overlaps the bore of the plug. As mentioned previously, when the drive shaft is rotating, the port plug rotates independently (and slower) than the thrust washer. Similar relative motion occurs at the front end of the port plug where it contacts the rear face of the inner gerotor element.

The port plug has the same number of teeth as an outer gerotor element does. There is only a small clearance between the outermost edge of the teeth of the port plug and the innermost edge of the conjugate teeth of the outer gerotor. This allows the port plug to act as a piston that can slide axially inside the outer gerotor. The outer rear face of the plug is in contact with fluid that is nominally at system pressure. The area of this face is the same as the area of the piston that is integral with the drive shaft (making these two areas equal is an important concept, because it allows the pump to behave dynamically like a double-rod-end equal-piston-area hydraulic cylinder with a spring mass load, as later described.). Thus, the outward piston face and rear face of the port can push the assembly in the housing.

The inner gerotor and port plug slide inside the outer gerotor. The outer gerotor member is driven by the inner gerotor member. The outer gerotor and the port plug rotate together at a slower speed than the inner gerotor. However, eccentricity between the inner and outer gerotor members is fixed.

In an exemplary embodiment, the variable displacement gear pump is displaced by a pressure compensator. In one embodiment, the pressure compensator senses the system pressure and then displaces the pump to meet the desired flow required by the system. The pressure compensator acts like a 3-position, 4-way, closed-center valve controlled by pressure operating against a return spring. As system pressure gets above or below the spring load pressure, it will displace the spool to a certain position, allowing a corresponding amount of flow into the pump. As the system pressure rises, the corresponding pressure upon the spring load will cause the spool to open until the spring load pressure equals the system pressure. Similarly, when the system pressure is lower than the spring load pressure, the spring will displace the compensator spool to close the opening until the spring load pressure equals the system pressure. When the compensator is in a neutral position, it allows the pump to produce flow to make up for internal leakages. This is provided by forming small v-shaped grooves on one end of the valve spool center land. The pressure compensator may either be external or integral with the pump.

The variable displacement gear pump, motor for driving the pump, pressure compensator and/or control system of the present invention is adapted for use in a number of different pressurized fluid systems and applications including but not limited to hydraulic systems, water systems, oil systems, and the like wherein a fluid constant output or liquid pump is needed.

Thus, a principal object of the present invention is to provide an improved variable displacement internal gear pump.

A related object of the present invention is to provide an improved variable displacement internal gear pump controlled by pressure.

A basic object of the present invention is to provide an internal gear pump wherein the displacement of the pump may be varied in response to a selected pressure output.

Another object of the present invention is to provide an improved internal gear pump with a variable displacement control system that is responsive to pressure.

Another object of the present invention is to provide an improved internal gear pump that may employ variable displacement to reduce inefficiency.

Yet another object of the present invention is to provide an improved internal gear pump to provide dependable operation while maintaining efficient operation as a result of variable displacement.

Another object of the present invention is to provide a pump that may be manufactured from a wider variety of materials than current vane and piston pumps.

A basic object of the present invention is to provide a feasible variable displacement internal gear pump that is simplistic in construction and fast-acting while retaining the durability and dependability of gear pumps.

Still yet, another object of the present invention is the provision of an internal gear pump and pressure compensator.

Another object of the present invention is the provision of a pressurized fluid system including an internal gear pump, motor, and controls.

DETAILED DESCRIPTION OF THE PREFERRED EMBODIMENTS

Figure 1:
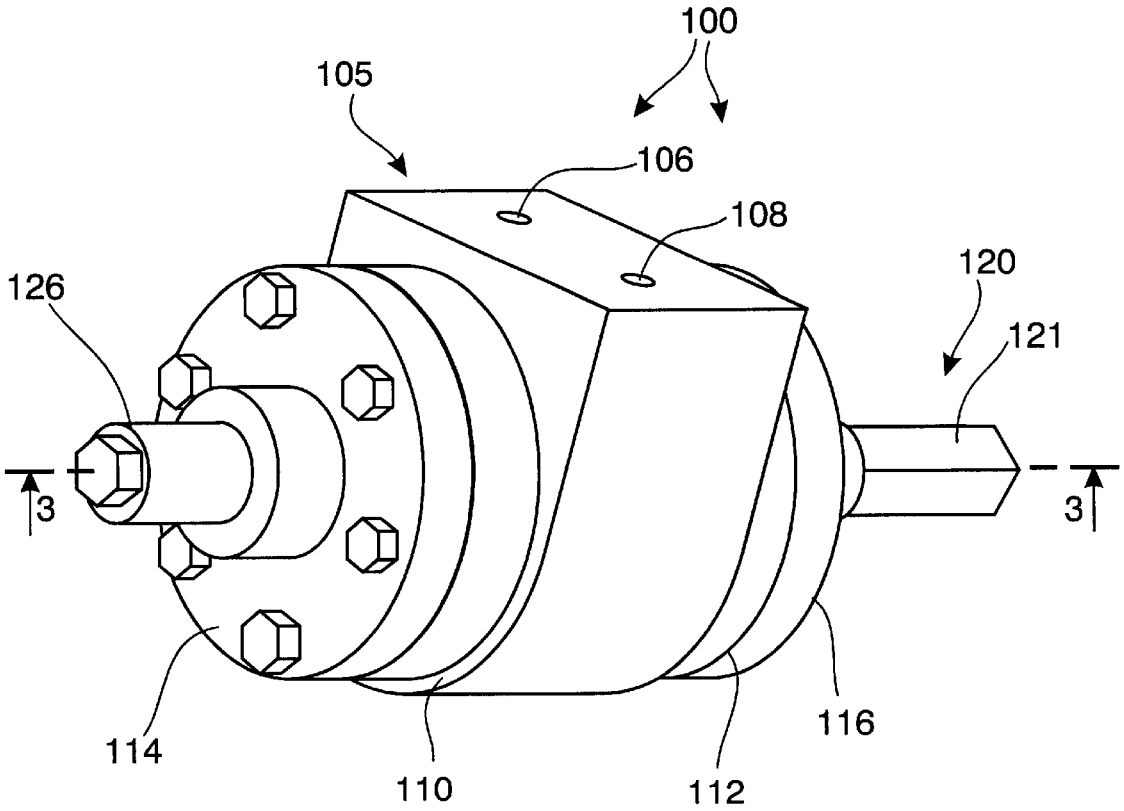
FIG. 1 is a perspective view of an exemplary embodiment of a pressure compensated variable displacement internal gear pump.

The improved internal gear pump of the present invention has a fixed gear axis eccentricity and varies displacement by moving controlling elements linearly along the drive shaft. The improved pump is very responsive to changing displacement requirements and can replace typical conventional fixed displacement gerotor pumps. Gerotor pumps are widely used because they are simple, rugged, compact and relatively inexpensive. However, constant pressure systems that use conventional gerotor pumps waste energy by exhausting excess flow at system pressure through relief valves.

In accordance with an exemplary embodiment of the present invention, an improved internal gear pump is generally designated by the reference numeral 100 in FIGS. 1–27. The pump 100 includes a housing 105 accepting fluids to be pumped and emitting pumped fluids. The housing 105 is penetrated by an elongated drive shaft 120 that is preferably rotatably driven by an associated motor or the like. The drive shaft 120 extends into the housing 105 where it rotates internal elements to pump the fluids into and out of the housing.

Figure 2:
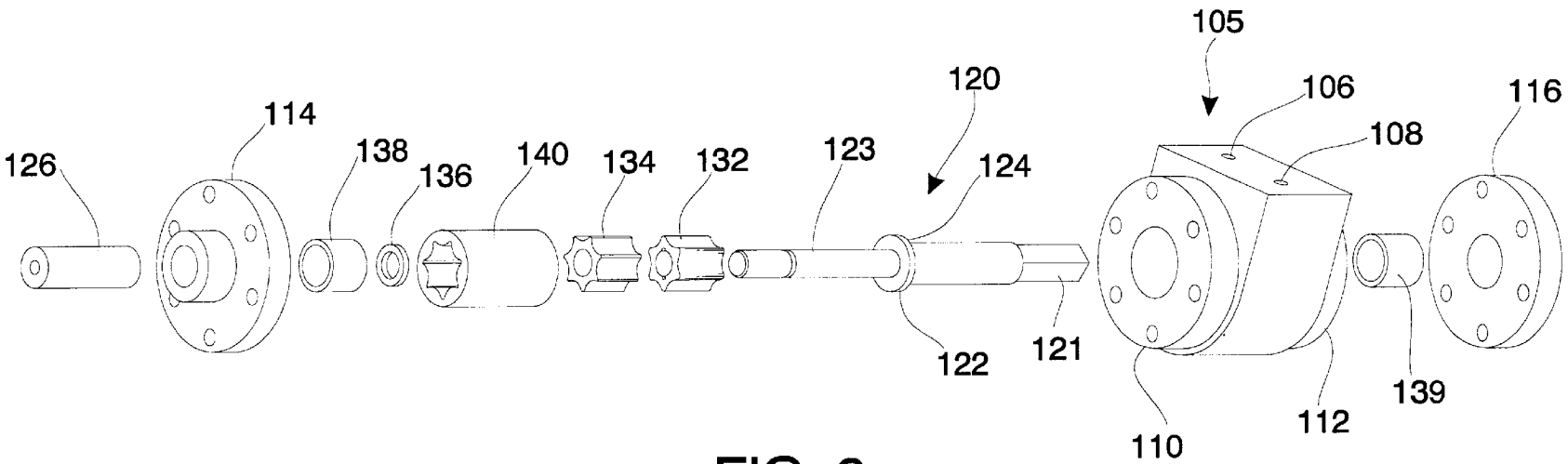
FIG. 2 is a partially exploded perspective view of the pump of FIG. 1
Figure 3:
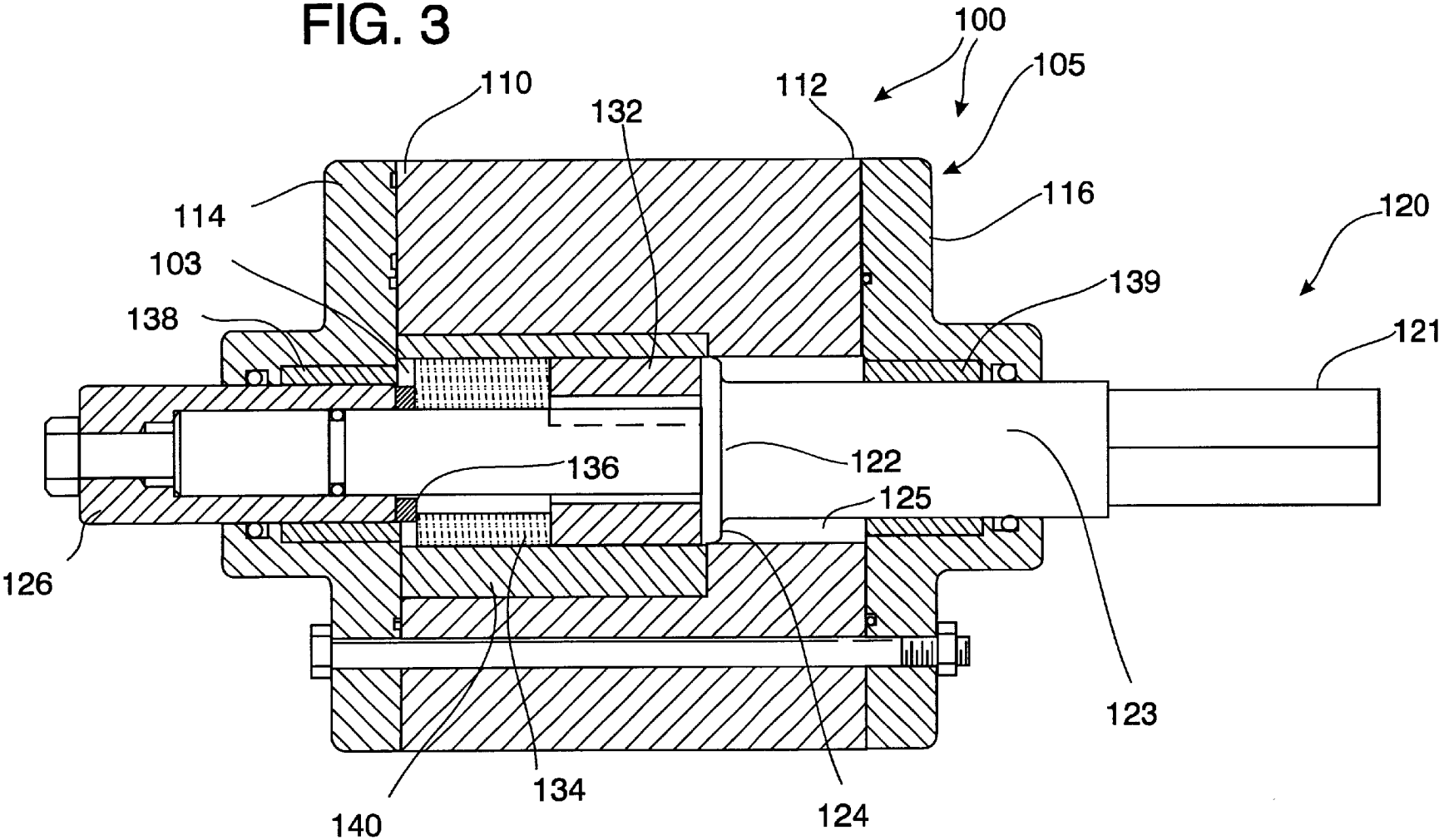
FIG. 3 is a cross sectional view taken along line 3—3 from FIG. 1.
Figure 4:
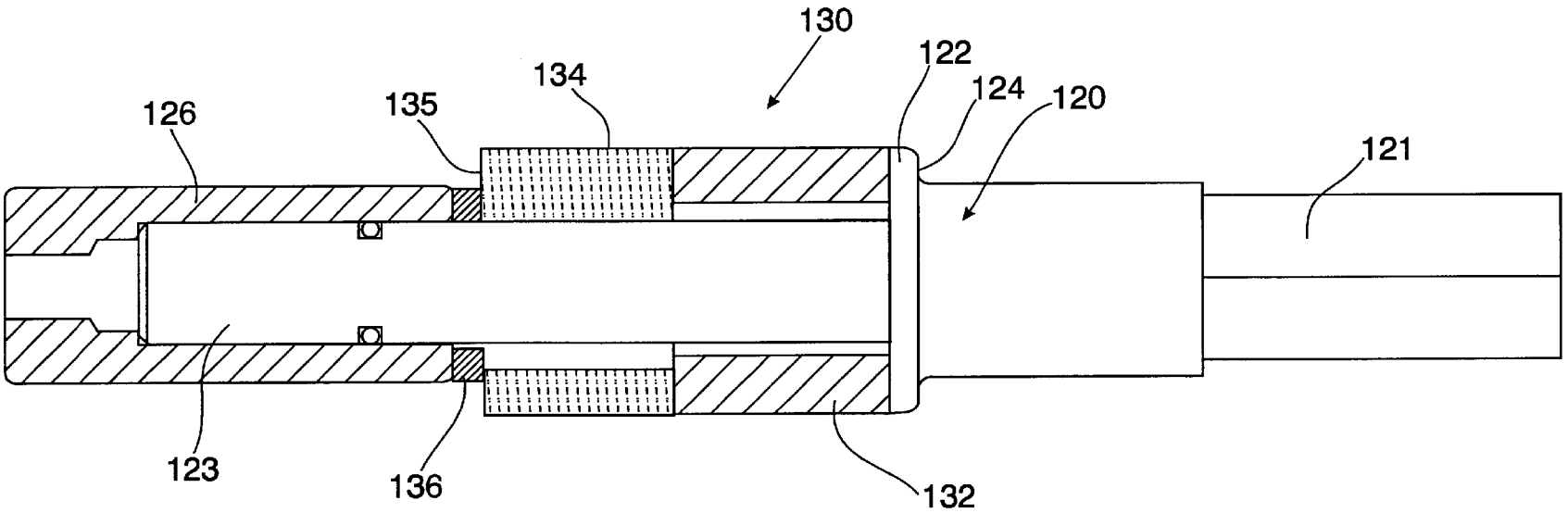
FIG. 4 is a side view of the axially moving assembly from FIG. 3.
Figure 5:
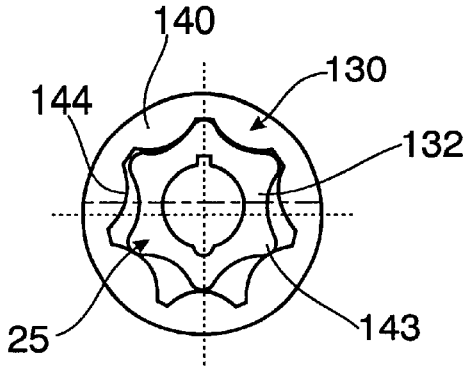
FIG. 5 is an end plan view of the inner and outer gerotor elements.
Figure 6:
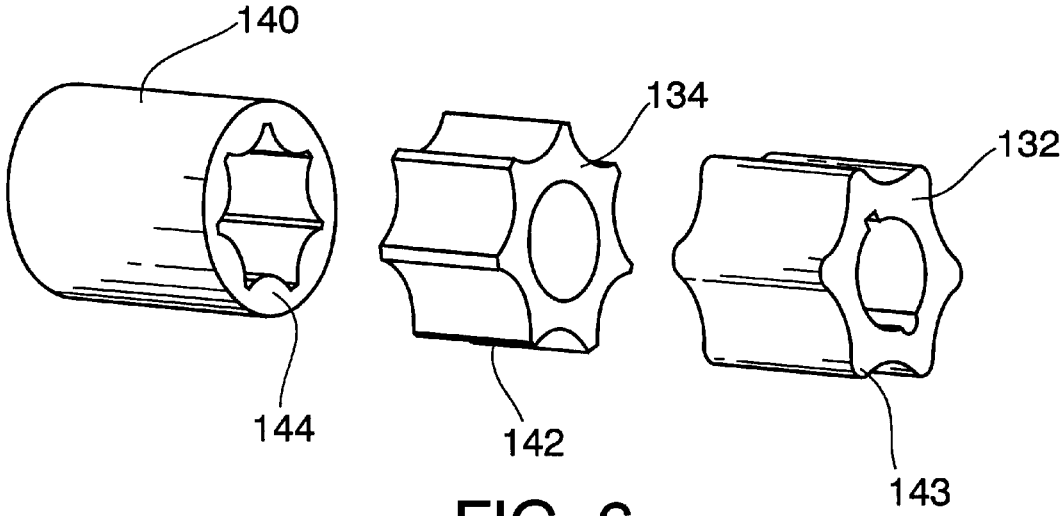
FIG. 6 is an enlarged partially exploded perspective view of the inner gerotor element and the port plug and the outer gerotor element.
Figure 7:
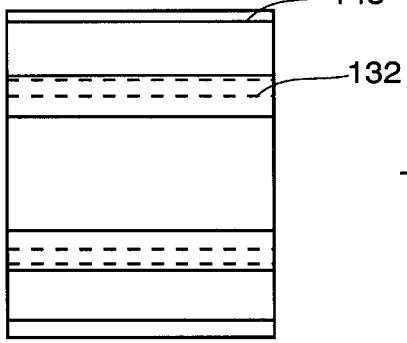
FIG. 7 is a side elevational view of the inner gerotor element, with the opposite side being a mirror image thereof.
Figure 8:
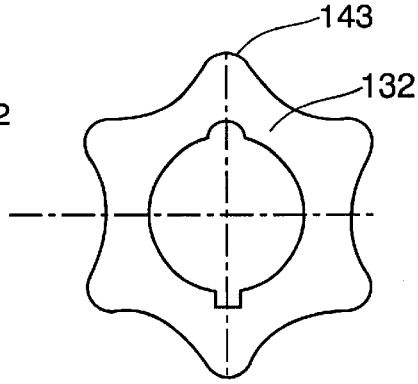
FIG. 8 is an end plan view of the inner gerotor element, with the opposite end being a mirror image thereof.
Figure 9:
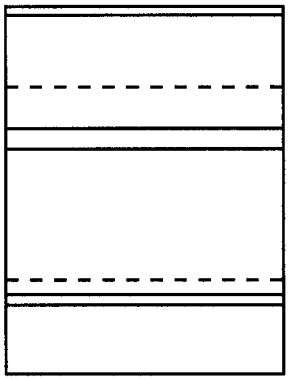
FIG. 9 is a side elevational view of the port plug, with the opposite side being a mirror image thereof.
Figure 10:
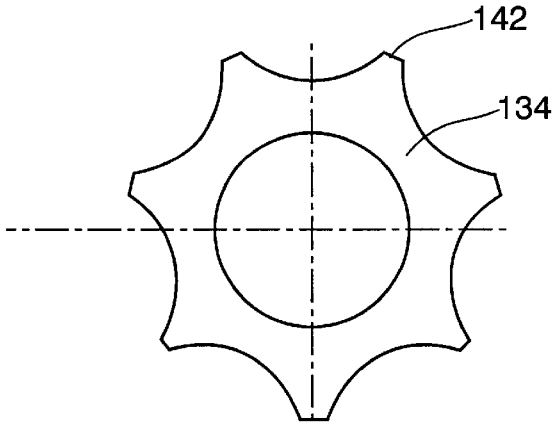
FIG. 10 is an end plan view of the port plug with the opposite end being a mirror image thereof.

Housing 105 is penetrated by flow ports 106 and 108 (FIGS. 1 and 2). The housing has spaced apart ends 110 and 112. An end plate 114 and 116 cap each end 110 and 112. The drive shaft 120 protrudes from end 112 while a retainer sleeve 126 protrudes from end 110. Housing 105 contains several internal pump components In the exemplary embodiment, the housing 105 contains an inner gerotor 132, a port plug 134, and an outer gerotor 140, all axially aligned upon the drive shaft 120. A thrust bearing 136 permits relative rotation inside the retainer sleeve along with bearings 138 and 139.

Several internal components slide along the longitudinal axis established by the drive shaft 120. These sliding components vary the fluid displacement of the pump 100. The axially-moving element assembly 130 includes the drive shaft 120, inner gerotor element 132, port plug 134, thrust bearing 136, and retainer sleeve 126 (see FIG. 4). The inner gerotor element 132 is keyed to the drive shaft 120 and, except for the port plug 134, the axially-moving element assembly 130 rotates as a unit.

Figure 24:
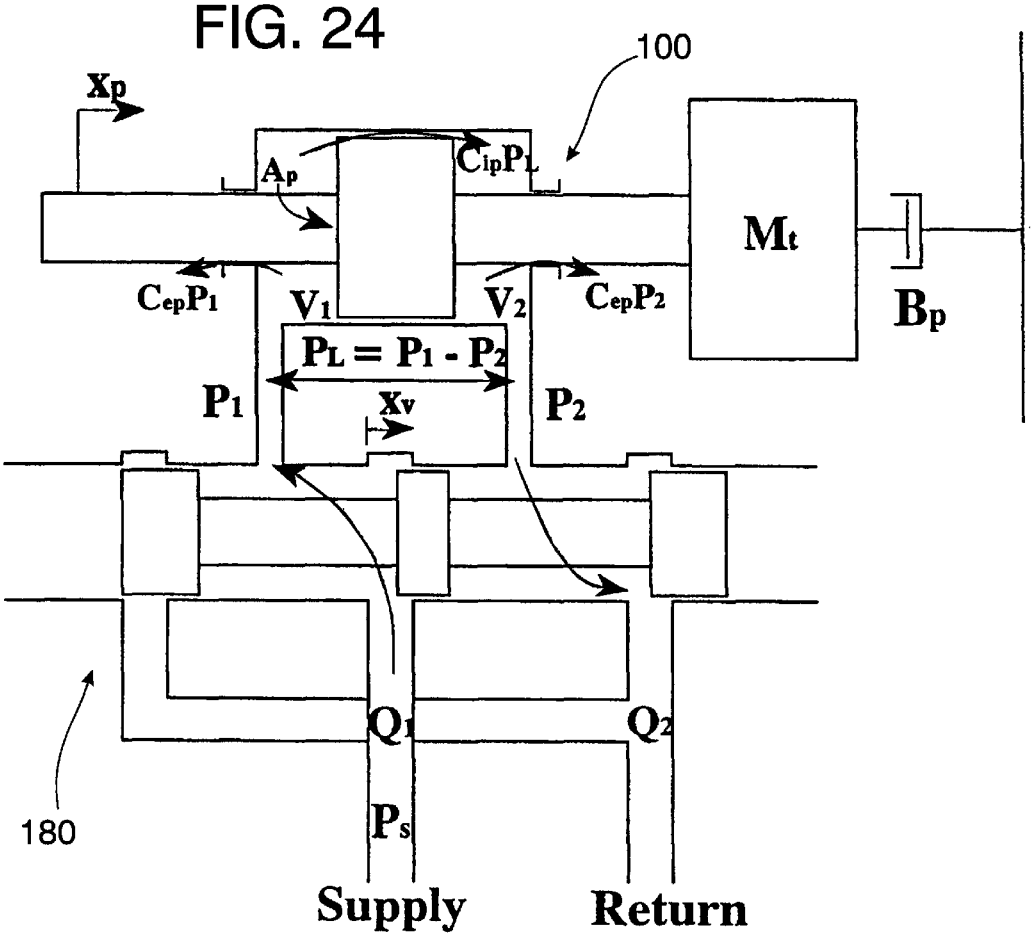
FIG. 24 is a schematic diagram depicting a valve piston combination.

The drive shaft 120 defines a coupling with a hexagonal cross-section or other shape of male spline that is formed at the driven end 121 of the drive shaft with a corresponding coupling formed in the end of the prime mover shaft from the motor (FIG. 24). This allows torque to be transmitted to the pump drive shaft 120, while facilitating simultaneous axial motion of the drive shaft with respect to the drive coupling. Minimum engagement length in the coupling assures that torque can be continuously transmitted when the drive shaft slides axially in response to pressure deviations, as will be discussed in detail hereinafter.

The driven end 121 of the drive shaft 120 terminates with an integral flanged piston 122 defining a boundary to an intermediate shaft section 123. The piston 122 also serves to axially retain the internal gerotor element 132 and port plug 134. Preferably, the outside diameter of the piston 122 is only slightly smaller than the inside diameter of the bore 125 in which it slides. The outward face 124 of the piston is in contact with fluid at system pressure. The internal gerotor element 132 and port plug 134 are retained against piston 122 by a thrust bearing 136 that slides over the intermediate shaft 123 and is held in place by the retainer sleeve 126. The inner face of the thrust bearing 136 contacts the inner periphery of the rear face 135 of the port plug 134 and overlaps the bore of the plug. As mentioned previously, when the drive shaft 120 rotates, the port plug 134 rotates independently from the thrust bearing 136. Similar relative motion occurs at the front end of the port plug where it contacts the rear face of the inner gerotor element.

The port plug 134 has the same number of teeth 142 as the outer gerotor element 140 does (i.e. seven). There is only a small clearance between the outermost edge of the teeth 142 of the port plug and the innermost edge of the conjugate teeth 144 of the outer gerotor. This allows the port plug to act as a piston that can slide axially inside the outer gerotor. The outer rear face 135 of the plug is in contact with fluid at system pressure. The area of this face 135 is the same as the area of the piston 124 that is integral with the drive shaft 120.

The inner gerotor 132 and port plug 134 slide inside the outer gerotor 140. The outer gerotor 140 member is driven by the rotation of the inner gerotor member 132, but the outer gerotor 140 and the port plug 134 rotate as a separate unit at a slower speed than the inner geroter 132. However, eccentricity between the inner and outer gerotor members is fixed by the meshing of the teeth 143 of the inner gerotor with the teeth 144 of the outer gerotor. The intermeshing teeth 143 and 144 define a pumping chamber 147 through which fluids are pumped.

Figure 11:
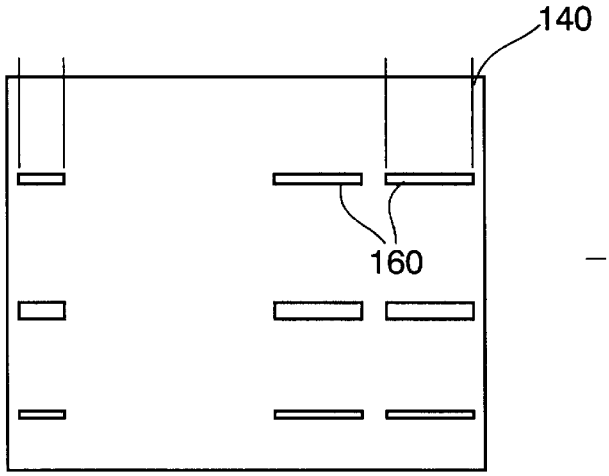
FIG. 11 is a side elevational view of the outer gerotor element, with the opposite side being a mirror image.
Figure 12:
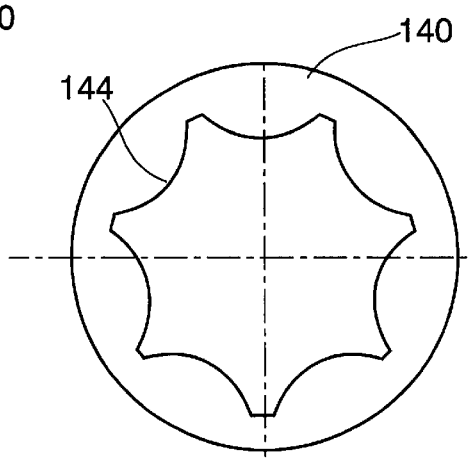
FIG. 12 is an end view of the outer gerotor element with the opposite end being a mirror image thereof.

When varying pump displacement, the inner gerotor 132 is displaced by the port plug 134 inside the outer gerotor 140. This increases or decreases the flow rates by opening and closing several intake and discharge ports 160 defined in the outer gerotor 140 (FIG. 11).

Figure 15:
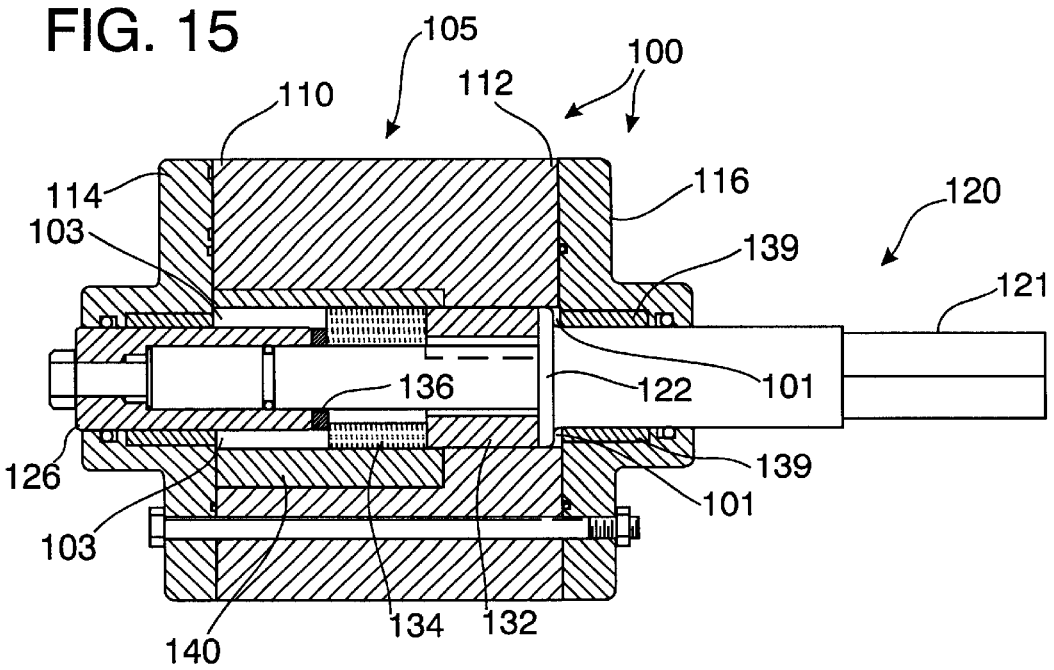
FIG. 15 is a cross-sectional view similar to FIG. 3, but showing the pump during low flow conditions.

The outer gerotor element 140 is preferably slightly longer than the combined lengths of the inner gerotor element 132 and port plug 134 When the drive shaft 125 is displaced fully to the left (FIG. 14) or rear, the right flat face of the inner gerotor element is a few millimeters to the rear of the right face of the outer gerotor element. When the inner element is in this position, it aligns width-wise with axial slots 160 in the outer gerotor element 140 and the pump 100 is in its maximum displacement configuration. The axial slots go radially through the outer element at root areas between the internal teeth 144. The inlet and outlet port widths in the pump housing 105 are the same as the axial lengths of the slots 160 in the outer gerotor element 140. As the drive shaft 125 moves to the right or front, the inner gerotor element 132 also moves to the right and out of engagement with the outer gerotor slots 160. At the same time, the port plug 134 moves into the slotted area. Thus, as the shaft moves to the right, the pump displacement is decreased. Full movement to the right reduces displacement to zero (FIG. 15).

Figure 13:
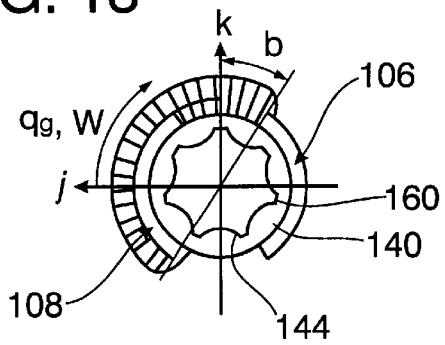
FIG. 13 is a partially fragmented, cross-sectional view of the outer gerotor and pump housing taken along line 13—13 from FIG. 3, with portions omitted for clarity.
Figure 13A:
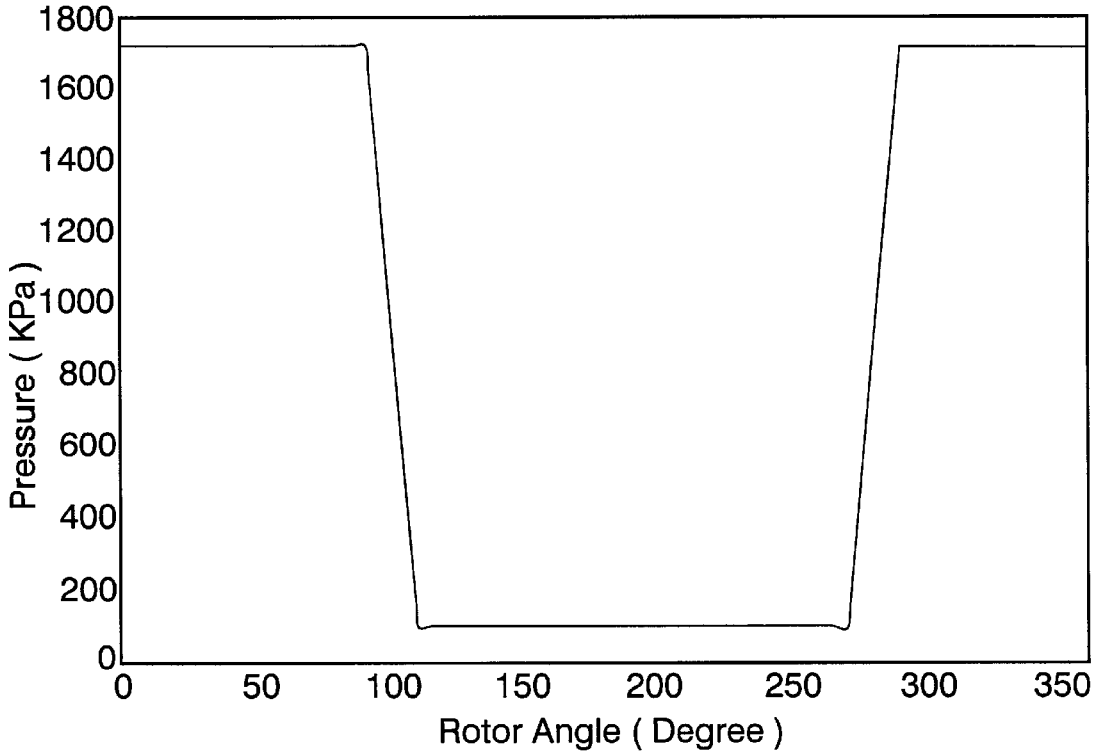
FIG. 13A is a graph of the pressure profile for the outer gerotor.
Figure 14:
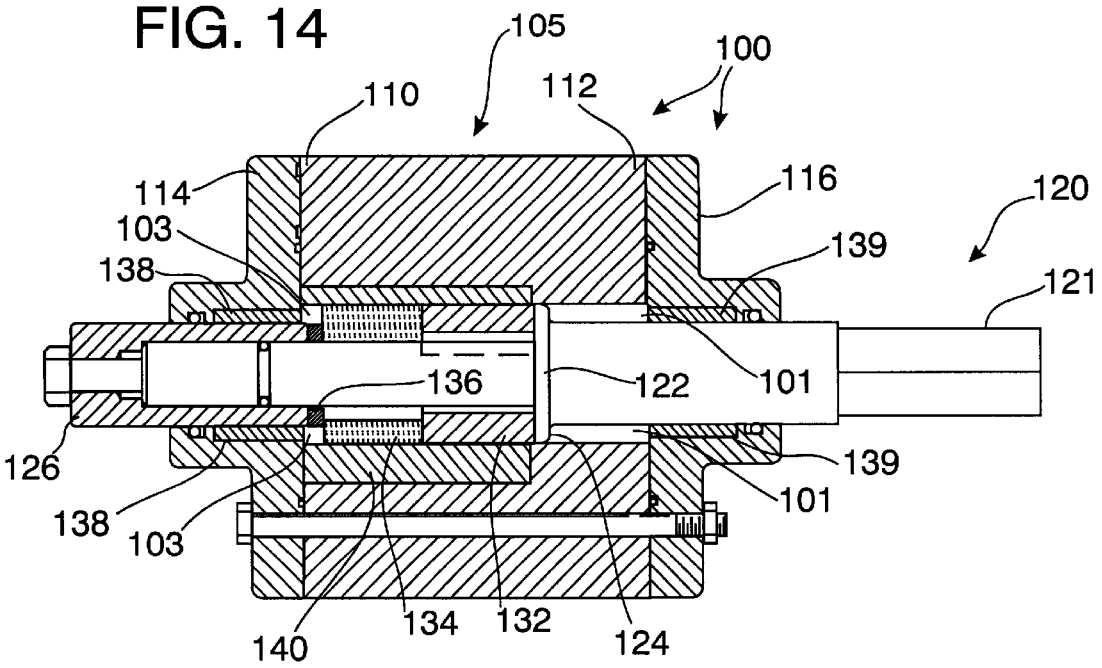
FIG. 14 is a cross-sectional view similar to FIG. 3, but showing the pump during high flow conditions.

Referring to FIG. 13, the pressure profile on the outer gerotor element as a function of angular displacement about its rotational axis is shown. Where the outer gerotor element contacts the discharge port cavity, the element face is exposed to discharge pressure, $P_d$. Where the element contacts the intake port cavity, the element face is exposed to intake pressure, $P_i$. In the transition region between intake port and discharge port cavities, pressure acting on the outer gerotor element face is assumed to increase linearly and outer rotor element pressure, $P_g$, as a function of the rotor's angle, $\theta_g$, is given as $$P_g = \begin{cases} P_d & 0 < \theta_g < \pi/2 \\ P_d - c(\theta_g - \pi/2) & \pi/2 < \theta_g < \pi/2 + \beta \\ P_i & \pi/2 + \beta < \theta_g < 3\pi/2 \\ P_i + c(\theta_g - 3\pi/2) & 3\pi/2 < \theta_g < 3\pi/2 + \beta \\ P_d & 3\pi/2 + \beta < \theta_g < 2\pi \end{cases}$$

where $c=(P_d-P_i)/\beta$ and $\beta$ is the transition region's angle. FIG. 13A is a graph of the pressure profile as described by the above equation.

Thus, the fluid displacement through the outer gerotor 140 may be varied by the alignment of the inner gerotor 132 and port plug 134 with respect to the slots 160 in outer gerotor 140. In particular, the longitudinal axis established by the driveshaft 120 provides a convenient avenue for variably displacing these components.

Figure 16:
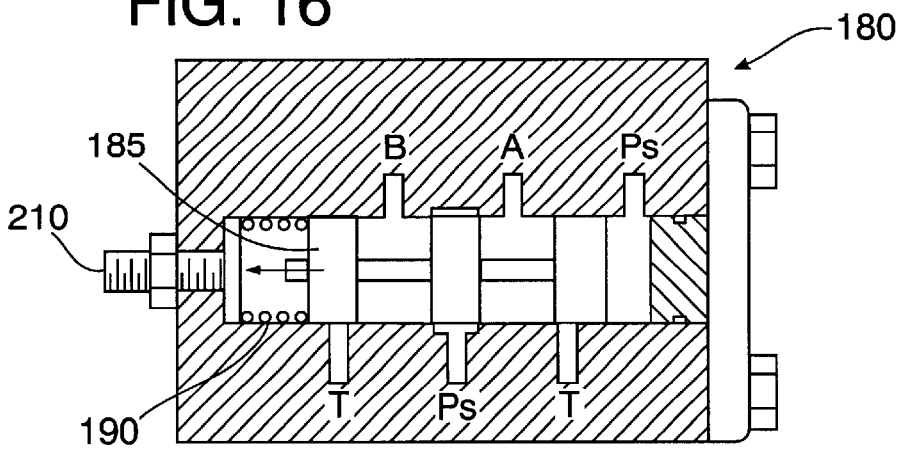
FIG. 16 is a schematic cross-section diagram of a pressure compensator.
Figure 17:
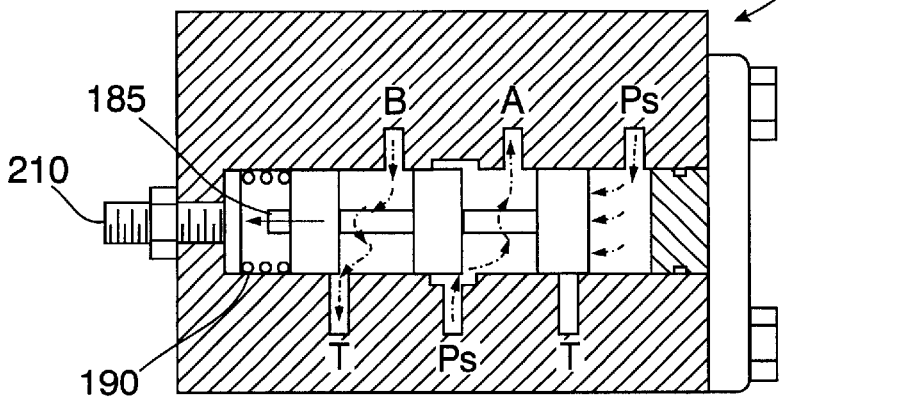
FIG. 17 is a schematic cross-section diagram of the pressure compensator of FIG. 16 during high flow conditions.
Figure 18:
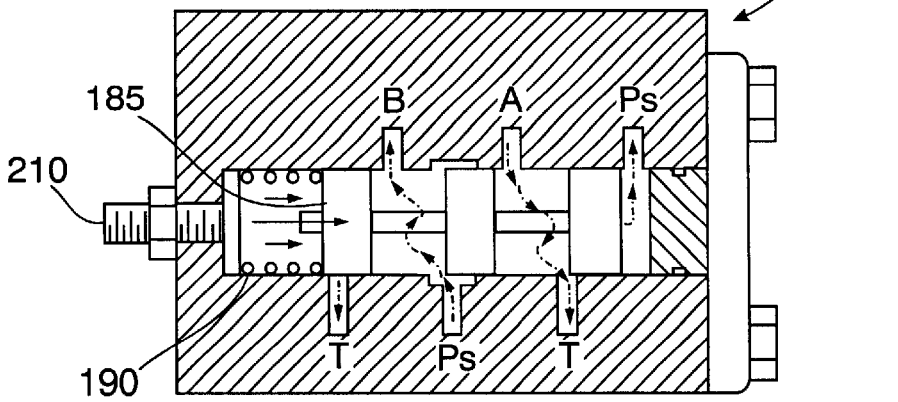
FIG. 18 is a schematic cross-section diagram of the pressure compensator of FIG. 16 during low flow conditions.

While several control systems may be employed with pump 100, including pressure compensation, direct manual manipulation, electrical and or hydraulic controls and the like, a pressure compensator 180 of FIGS. 16–18 works well. In the following exemplary embodiments, the axially displaceable assembly 130 is displaced by a pressure compensator or control 180 (FIGS. 16–27). In these embodiments, the pressure compensator senses the system pressure and then displaces the assembly 130 to meet the desired flow required by the system. The pressure compensator 180 acts like a 3-position, 4-way, closed-center valve controlled by pressure operating against a return spring 190 (FIG. 16). As system pressure gets above or below the spring load pressure, it will displace a spool 185 to a certain position, allowing a corresponding amount of flow into the pump 100. As the system pressure rises, the corresponding pressure upon the spring load will cause the spool 185 to open until the spring load pressure equals the system pressure (FIG. 17). Similarly, when the system pressure is lower than the spring load pressure, the spring 190 will displace the compensator spool 185 to close the opening until the spring load pressure equals the system pressure (FIG. 18). When the compensator 180 is in a neutral position, it allows the pump 100 to produce flow to make up for internal leakages. This is provided by forming small v-shaped grooves on one end of the valve spool center land.

The purpose of adjustment screw 210 is to allow the presetting of desired system pressure. Rotation of the screw 210 increases or decreases the force which the spring 190 applies to the right end of the spool 185. As the spring force increases, a larger system pressure is required to shift the valve spool 185 back to neutral. The small increase or decrease in system pressure will be sensed by the control valve 180, which will cause the pump's displacement to change, maintaining essentially constant system pressure.

Should an external load cause system pressure to increase, the control valve spool 185 will quickly shift to the left. As the valve shifts to the left, system pressure is ported to chamber 201 while chamber 203 is vented to the tank. Resulting pressure unbalance across the moveable internal assembly 130 will cause the assembly 130 to shift to the right, decreasing pump displacement. The shift will continue until system pressure drops to its preset value or the pump displacement reduces to zero.

If system pressure falls below the preset value, the control valve spring force will be greater than the force caused by pilot pressure acting on the valve spool. This imbalance force shifts the spool to the right. This exposes chamber 203 to system pressure while venting chamber 201. Now the pressure unbalance across the moveable assembly will push the assembly toward the left, increasing pump displacement. Again, shifting will continue until system pressure increases to its preset value or until the pump displacement reaches its maximum. The pressure compensator 180 may either be external or integrally coupled to the pump 100.

Figure 19:
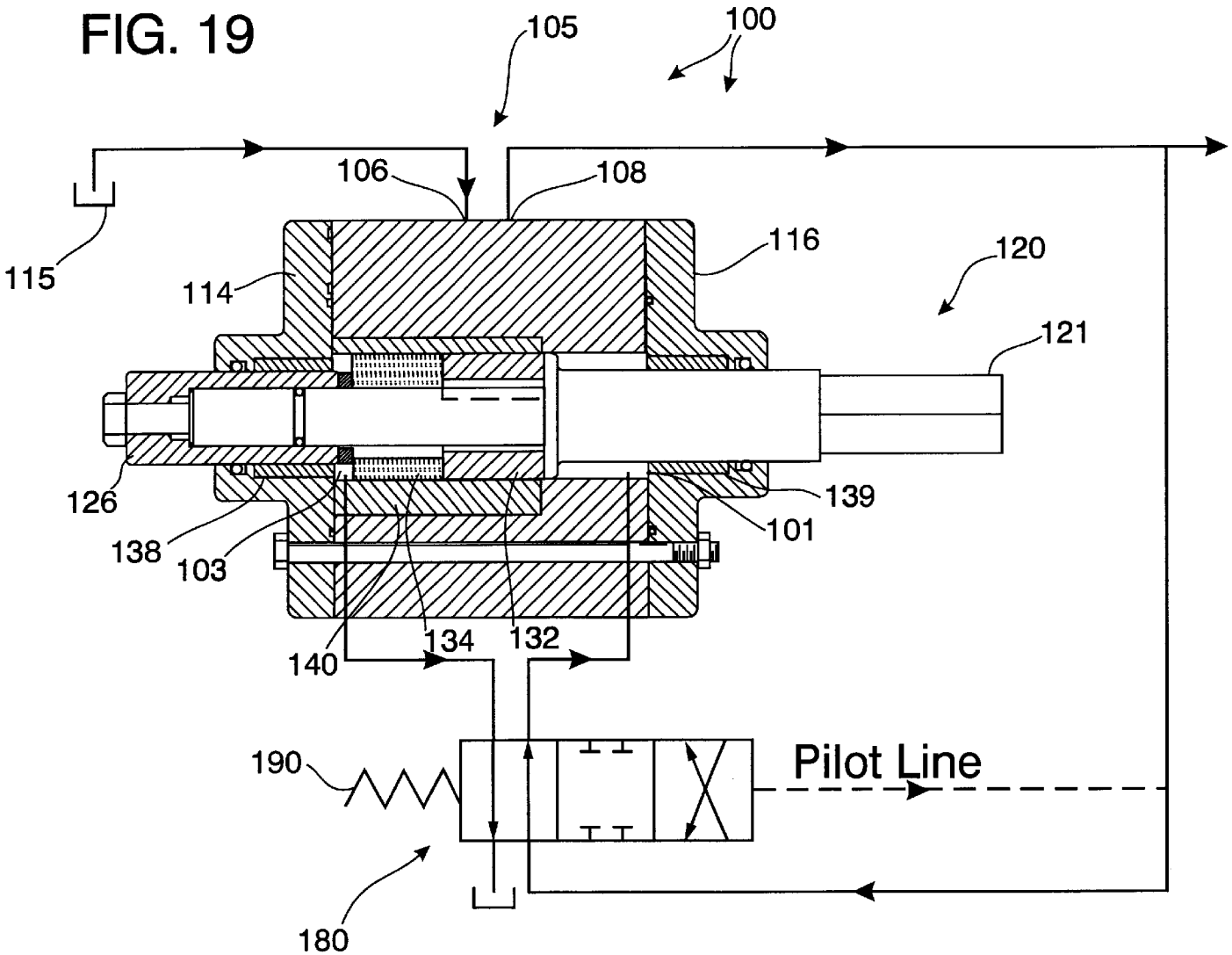
FIG. 19 is a schematic view showing an external pressure compensator controlling an associated gear pump during high flow conditions.
Figure 20:
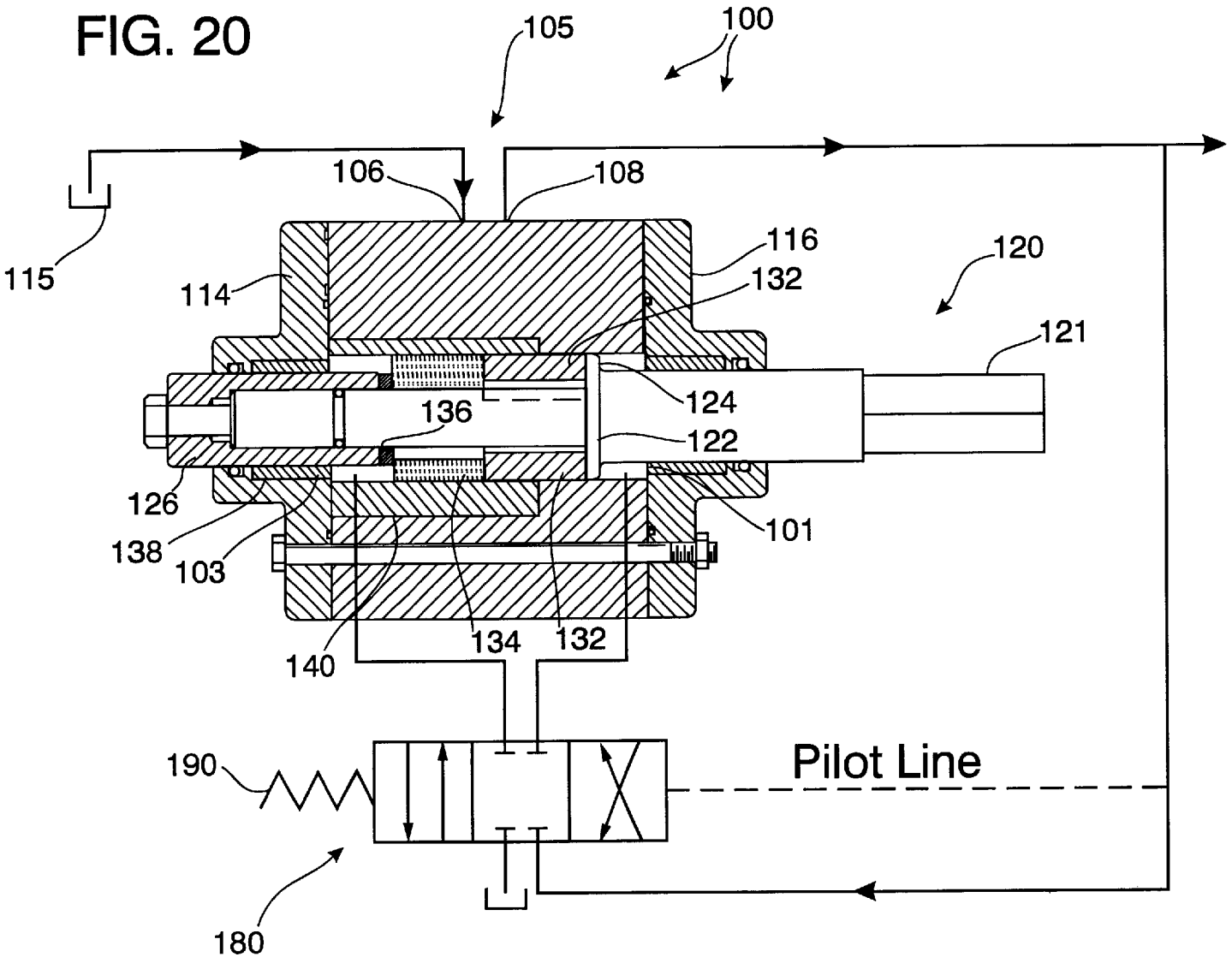
FIG. 20 is a schematic view showing the compensator of FIG. 19 controlling the associated gear pump during equilibrium flow conditions.
Figure 21:
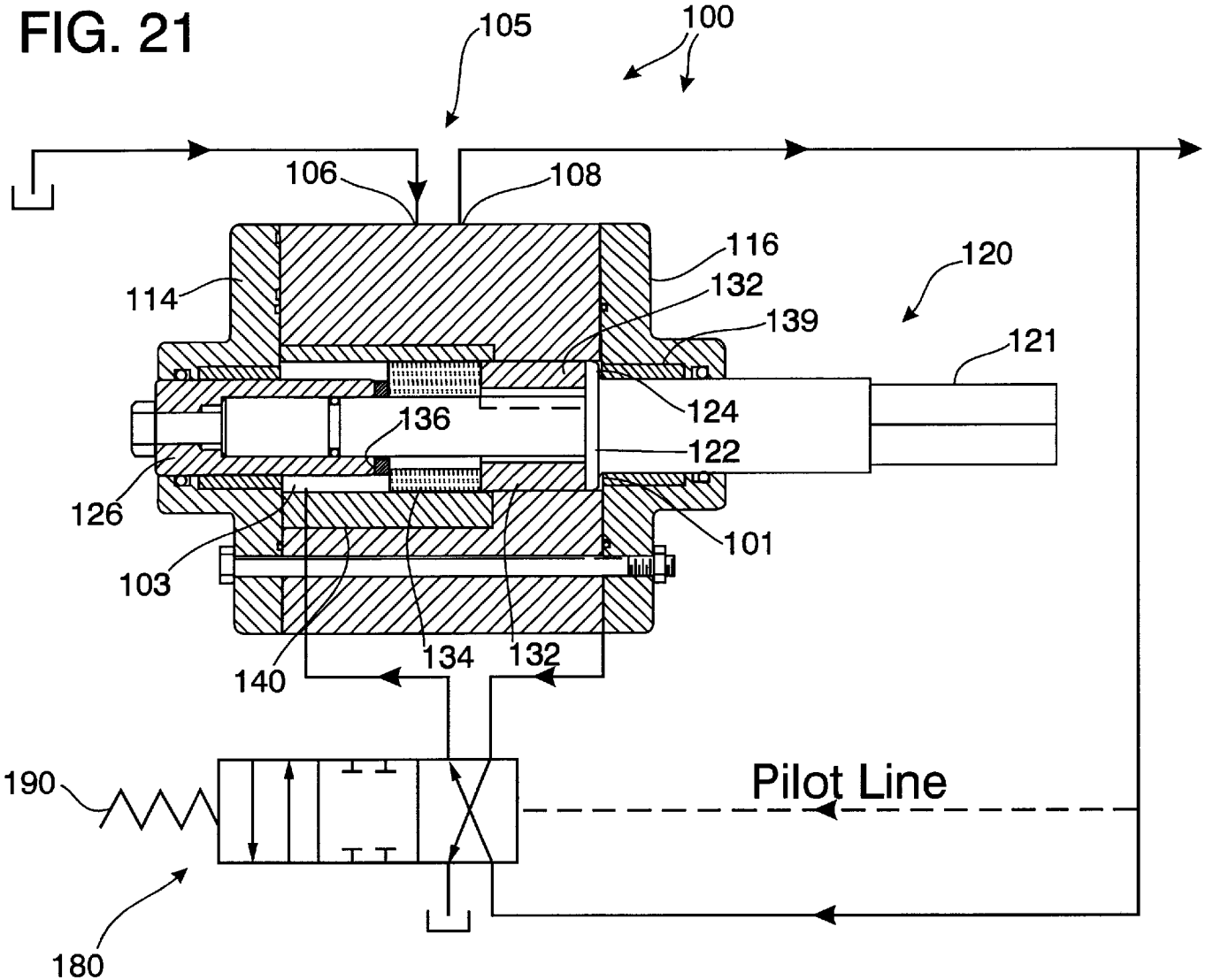
FIG. 21 is a schematic view showing the pressure compensator of FIG. 19 controlling the associated gear pump during low flow conditions.

In an exemplary embodiment, the compensator is remotely connected to the system (FIGS. 19–21). The pressure compensator 180 channels fluid flow between the intake and discharge ports 106 and 108, the system 113 and an associated reservoir 115. The compensator 180 includes an elongated rod 186 with at least three lands or dividers 187, 188 and 189 moving in an internal channel 184. As the system pressure gets above or below the spring load pressure, the spool 185 moves the dividers between the ports to allow the fluid flow into the pump 100 to change correspondingly. The internal spring 190 is captivated between the inner cavity wall 191 and the first divider 187. Middle divider 188 separates two separate pressure compartments 186A and 186B. The first divider 187 and the middle divider 188 define the compartment 186A. The last divider 189 defines the other boundary for compartment 186B. An adjustment screw 210 allows the presetting of desired system pressure. Rotation of the screw 210 increases or decreases the force which the spring 190 applies to the left end of the spool 185. As the spring force increases, a larger system pressure is required to shift the valve spool 185 back to neutral. The small increase or decrease in system pressure will be sensed by the control valve, which will cause the pump's displacement to change, maintaining essentially constant system pressure.

Should an external load cause system pressure to increase, the control valve spool 185 will quickly shift to the left. As the valve shifts to the left, system pressure is ported to chamber 201 while chamber 203 is vented to the tank. Resulting pressure unbalance across the moveable internal assembly 130 will cause the assembly 130 to shift to the right, decreasing pump displacement. The shift will continue until system pressure drops to its preset value or the pump displacement reduces to zero.

If system pressure falls below the preset value, the control valve spring force will be greater than the force caused by pilot pressure acting on the valve spool. This imbalance force shifts the spool to the right. This exposes chamber 203 to system pressure while venting chamber 201. Now the pressure unbalance across the moveable assembly will push the assembly 130 of pump 100 toward the left, increasing pump displacement. Again, shifting will continue until system pressure increases to its preset value or until the pump displacement reaches its maximum.

Figure 22:
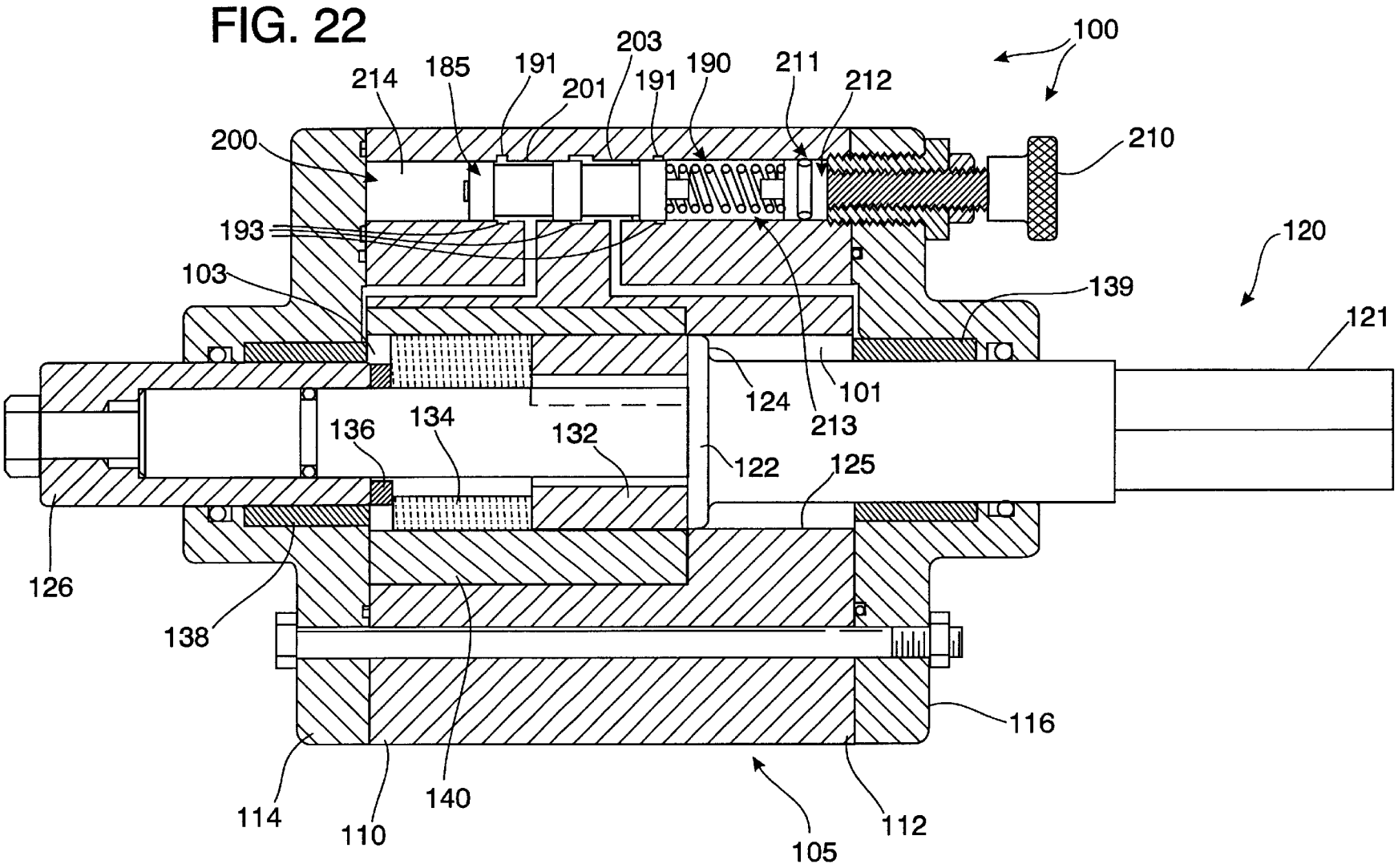
FIG. 22 is a cross-sectional view similar to FIG. 3 but showing another exemplary embodiment wherein the variable displacement gerotor pump has been combined with an integral pressure compensator.

In the exemplary embodiment shown in FIG. 22, the pump 100 includes an integral compensator with a closed center servovalve 200 which controls the axial position of the moveable element 130. The purpose of the adjustment screw 210 is to allow the presetting of desired system pressure. Rotation of the screw 210 increases or decreases the force which the spring 190 applies to the right end of the spool 185. As the spring force increases, a larger system pressure is required to shift the valve spool 185 back to neutral. The small increase or decrease in system pressure will be sensed by the control valve, which will cause the pump's displacement to change, maintaining essentially constant system pressure. System pressure is piloted to the servovalve via ports 191 and 193 and acts on the valve spool 185 to produce a force that exactly balances the valve preset spring 190. Pump chambers 101 and 103 contain fluid at equal pressures so that the axially moving assembly 130 is held in equilibrium.

Should an external load cause system pressure to increase, the control valve spool will quickly shift to the right. As the valve shifts to the right, system pressure is ported to chamber 201 while chamber 203 is vented to the tank. Resulting pressure unbalance across the moveable internal assembly 130 will cause the assembly 130 to shift to the right, decreasing pump displacement. The shift will continue until system pressure drops to its preset value or the pump displacement reduces to zero.

If system pressure falls below the preset value, the control valve spring force will be greater than the force caused by pilot pressure acting on the valve spool. This imbalance force shifts the spool to the left. This exposes chamber 203 to system pressure while venting chamber 201. Now the pressure unbalance across the moveable assembly will push the assembly 130 toward the left, increasing pump displacement. Again, shifting will continue until system pressure increases to its preset value or until the pump displacement reaches its maximum.

Figure 23:
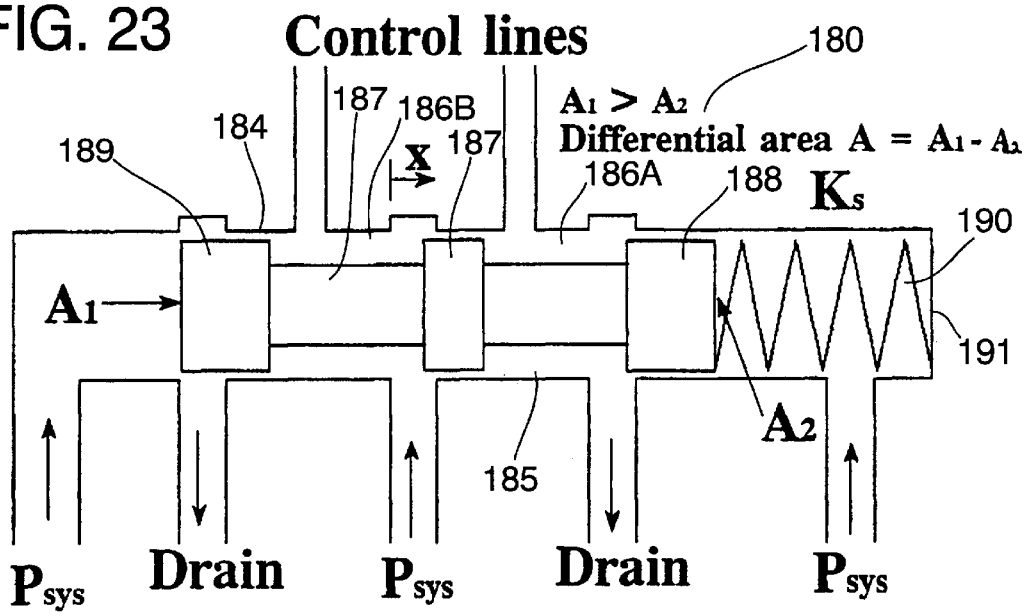
FIG. 23 is a schematic diagram depicting a pressure sensing valve dynamic model.

A schematic representation of the pressure sensing control valve 180 is shown in FIGS. 23 and 24. This valve balances pump output pressure ($P_{sys}$) acting on the spool differential area (A) against a spring force. As the pump output pressure ($P_{sys}$) increases, the spool shifts to the right and as the pump output pressure ($P_{sys}$) decreases, the force of spring causes the spool to shift to the left.

The spool is formed with $A_2$ slightly smaller than $A_1$. The pump output pressure ($P_{sys}$) acts on both ($A_1$) and ($A_2$.) A net force then results from the pump output pressure ($P_{sys}$) acting on a small differential area ($A=A_1-A_2$). This is done to allow a small spring to be used.

Using Laplace transform notation, the dynamic force balance equation for the spool system can be written as $$P_{sys}A=M_v s^2 X(s)+\alpha s X(s)+(K_s+K_l)\,X(s) \tag{2}$$

where $\alpha$ is the spool damping coefficient, $K_s$, is the spring constant, $K_l$ is the spring constant of the trapped fluid in the valve chambers and fluid passages, and $M_v$ is the mass of the spool plus one-third of the spring mass. This equation is then re-arranged to result in the following transfer function for the valve. The transfer function of this sensor is then, $$\frac{X_v}{P_{sys}} = \frac{A/(K_s+K_l)}{[M_v/(K_s+K_l)]s^2+[\alpha/(K_s+K_l)]s+1} \tag{3}$$

The transfer function is terms of resonant frequency is $$\frac{X_v}{P_{sys}} = \frac{A/(K_s+K_l)}{\frac{1}{\omega_n^2}s^2+\frac{2\delta}{\omega_n}s+1} \tag{3}$$

where $$\omega_n = \sqrt{\frac{(K_s+K_l)}{M_v}} \tag{4}$$

$$\delta = \frac{\alpha}{2(K_s+K_l)}\sqrt{\frac{(K_s+K_l)}{M_v}} \tag{5}$$

or $$\frac{\alpha}{2\sqrt{(K_s+K_l)M_v}}$$

$\omega_n$ is the natural frequency of the valve spool and $\delta$ is the damping factor of the system.

Figure 25:
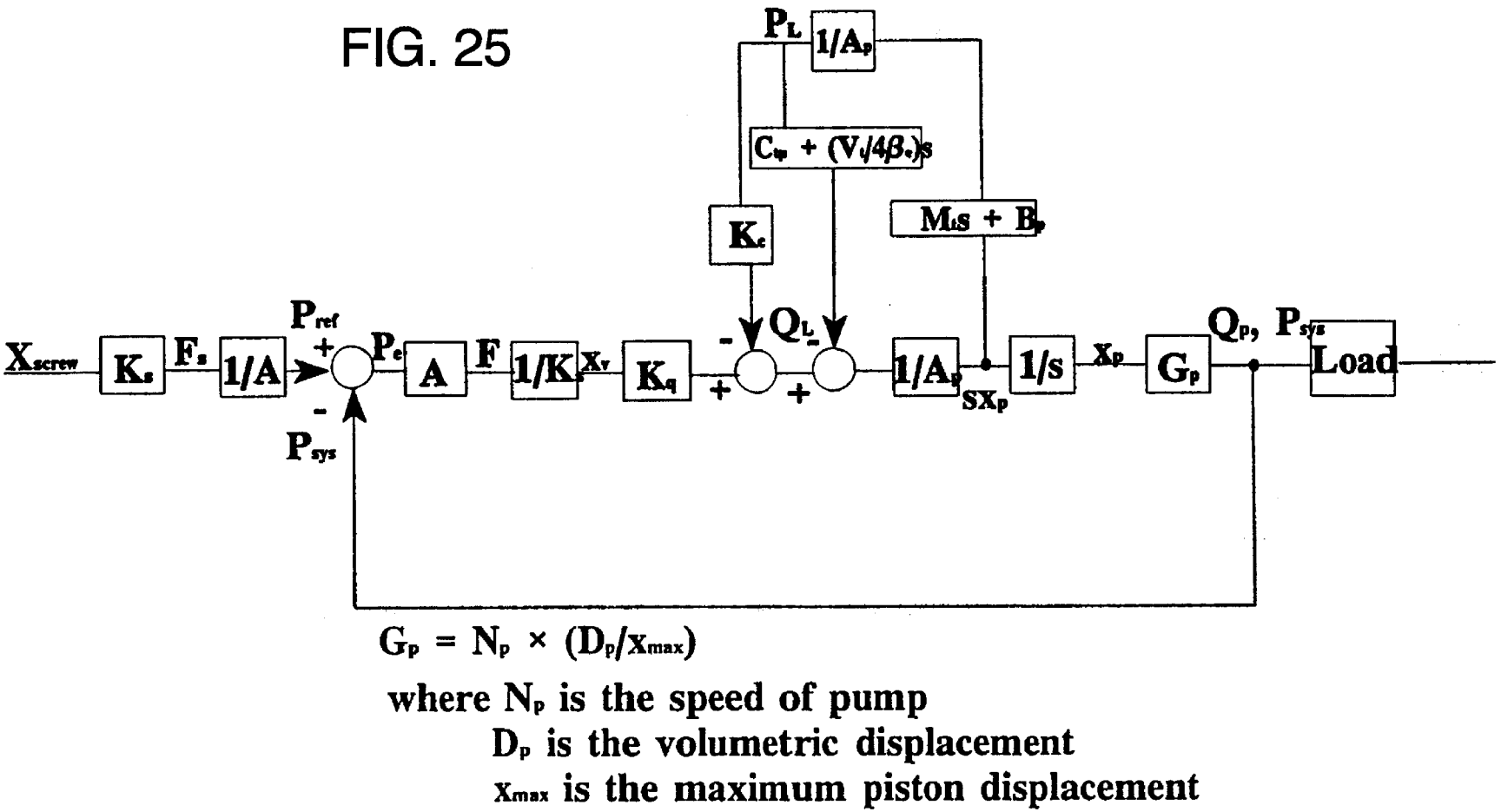
FIG. 25 is a block diagram of a valve controlled pump.

The control valve and pump combination may be modeled as a valve-controlled, double rod end, equal area piston with a mass and damper load as shown in FIG. 25. In the following equations, $M_t$ is the total mass of all the axially-moveable parts of the pump assembly and $B_p$ is the damping coefficient that results from viscous friction in the sliding parts. Flow through a variable area orifice is a non-linear function of pressure as indicated by the equation $$Q = x_v w C_d \sqrt{\frac{2P}{\rho}} \tag{7}$$

where $C_d$ is the coefficient of discharge for orifice, $x_v$ is the valve spool displacement from center position, P is the pressure drop through the orifice, and $\rho$ is the mass density of the fluid.

Since valve operation will nearly always be near the null ($x_v$=0) position, we can linearlize Equation 6 as follows:

$$dQ = \frac{\partial Q}{\partial x}dx + \frac{\partial Q}{\partial P}dP \tag{7a}$$

in terms of load flow, we can rewrite Equation 7a as follows $$Q_L=K_q x_v-K_c P_L \tag{7b}$$

Applying the continuity equation to the piston chambers gives $$Q_1 - C_{ip}(P_1-P_2) - C_{ep}P_1 = \frac{dV_1}{dt} + \frac{V_1}{\beta_e}\frac{dP_1}{dt} \tag{8}$$

$$C_{ip}(P_1-P_2) - C_{ep}P_2 - Q_2 = \frac{dV_2}{dt} + \frac{V_2}{\beta_e}\frac{dP_2}{dt} \tag{9}$$

where $V_1$ is the volume of forward chamber, $V_2$ is the volume of return chamber, $C_{ip}$ is the internal leakage coefficient of pump, $\beta_e$ is the effective bulk modulus, and $C_{ep}$ is the external leakage coefficient of pump. The volumes of the piston chambers can be written as $$V_1=V_{01}+A_p x_p \tag{10}$$

$$V_2=V_{02}-A_p x_p \tag{11}$$

where $A_p$ is the area of piston, $x_p$ is the displacement of piston, $V_{01}$ is the initial volume of forward chamber, and $V_{02}$ is the initial volume of return chamber. The piston position will be assumed to be in the center resulting in equal volumes, which is $$V_{01}=V_{02}=V_0 \tag{12}$$

The sum of the two volumes are independent of piston position. Therefore, $$V_t=V_1+V_2=V_{01}+V_{02}=2V_0 \tag{13}$$

The volume and continuity equations can be combined to give $$Q_L = A_p s X_p + C_L P_L + \frac{V_t}{4\beta_e} s P_L \tag{14}$$

where $C_L$ is the leakage coefficient.

Applying Newton's second law to the forces on the piston, and taking the Laplace transformed gives $$F_g=A_pP_L=M_ts^2X_p+B_psX_p \tag{15}$$

Solving Equations 7b, 14, and 15 simultaneously gives $$X_p = \frac{\frac{K_q}{A_p}X_v}{s\left[\left(\frac{V_tM_t}{4\beta_eA_p^2}\right)s^2+\left(\frac{K_{ce}M_t}{A_p^2}+\frac{B_pV_t}{4\beta_eA_p^2}\right)s+\left(1+\frac{B_pK_{ce}}{A_p^2}\right)\right]} \tag{16}$$

where $K_{ce}=K_c+C_L$ is the total flow-pressure coefficient.

For power output device $B_pK_{ce}/A_p^2$ is usually much smaller than unity. Applying these conditions to Equation 16 gives the $$X_p = \frac{\frac{K_q}{A_p}X_v}{s\left(\frac{s^2}{\omega_h^2}+\frac{2\delta_h}{\omega_h}s+1\right)} \tag{17}$$

where $$\omega_h = \sqrt{\frac{4\beta_eA_p^2}{V_tM_t}} \tag{18}$$

$$\delta_h = \frac{K_{ce}}{A_p}\sqrt{\frac{\beta_eM_t}{V_t}} + \frac{B_p}{4A_p}\sqrt{\frac{V_t}{\beta_eM_t}} \tag{19}$$

By substituting Equation 3 into Equation 17, we can get the transfer function of the valve controlled pump $$\frac{X_p}{P_{sys}} = \frac{[A/(K_s+K_l)]\cdot(K_c/A_p)}{s\left(\frac{s^2}{\omega_h^2}+\frac{2\delta_h s}{\omega_h}+1\right)\cdot\left(\frac{s^2}{\omega_n^2}+\frac{2\delta s}{\omega_n}+1\right)} \tag{20}$$

By way of example, with the transfer function derived for the control valve, frequency response curve can be plotted. As mentioned earlier, the derived transfer function for the control valve is $$\frac{X}{P_{sys}} = \frac{A/(K_s+K_l)}{\frac{1}{\omega_n^2}+\frac{2\zeta}{\omega_n}s+1}$$

where $$\omega_n = \sqrt{\frac{(K_s+K_l)}{M_v}}$$

and $$\delta = \frac{\alpha}{2\sqrt{(K_s+K_l)M_v}}$$

Dynamic parameters were calculated for use in frequency response analyses. The following parameter values are:

$A\approx 0.943$ in$^2$ $K_s\approx 9.5$ lb/in $K_l\approx 0$ lb/in (Assuming spring rate of fluid is zero)

$M\approx 1.90\times10^{-4}$ lb$_f$ sec$^2$/in (Assuming valve spool is made of stainless steel)

$C\approx 0.001$ in $\mu\approx 1.4507\times10^{-5}$ lb$_f$ sec/in$^2$ $\alpha\approx 13.68\times10^{-3}$ lb$_f$ sec/in The viscosity of fluid, $\tau$, to relative motion of the spool can be written as $$\tau = \frac{F}{A} = \mu\frac{dv}{dy}$$

where the surface area, A, of the lands are given as $$A=\pi DL$$

D is the diameter of the valve's spool and L is the total length of the lands. And the rate of deformation or shear rate is given by $$\frac{dv}{dy} = \frac{d(x)/dt}{C}$$

where C is the clearance of the valve's spool with its sleeve. Equating force F, in terms of area A, we have $$F = \mu A\frac{dv}{dy}$$

therefore $$F = \left(\frac{A}{C}\mu\right)\frac{d}{dt}(x)$$

Finally, by summing the forces on the spool of the control valve, we can obtain another equation $$F = M_v\frac{d^2}{dt^2}(x) + \alpha\frac{d}{dt}(x) + (K_s+K_l)x$$

by comparing coefficients of the last two equations, drag coefficient of this system can be calculated, which is $$\alpha=A/C\mu$$

By substituting the above calculated parameter values in to the transfer function we have $$\frac{X}{P_{sys}} = \frac{0.0993}{(2.0\times10^{-5})s^2+(1.44\times10^{-3})s+1}$$

Figure 26:
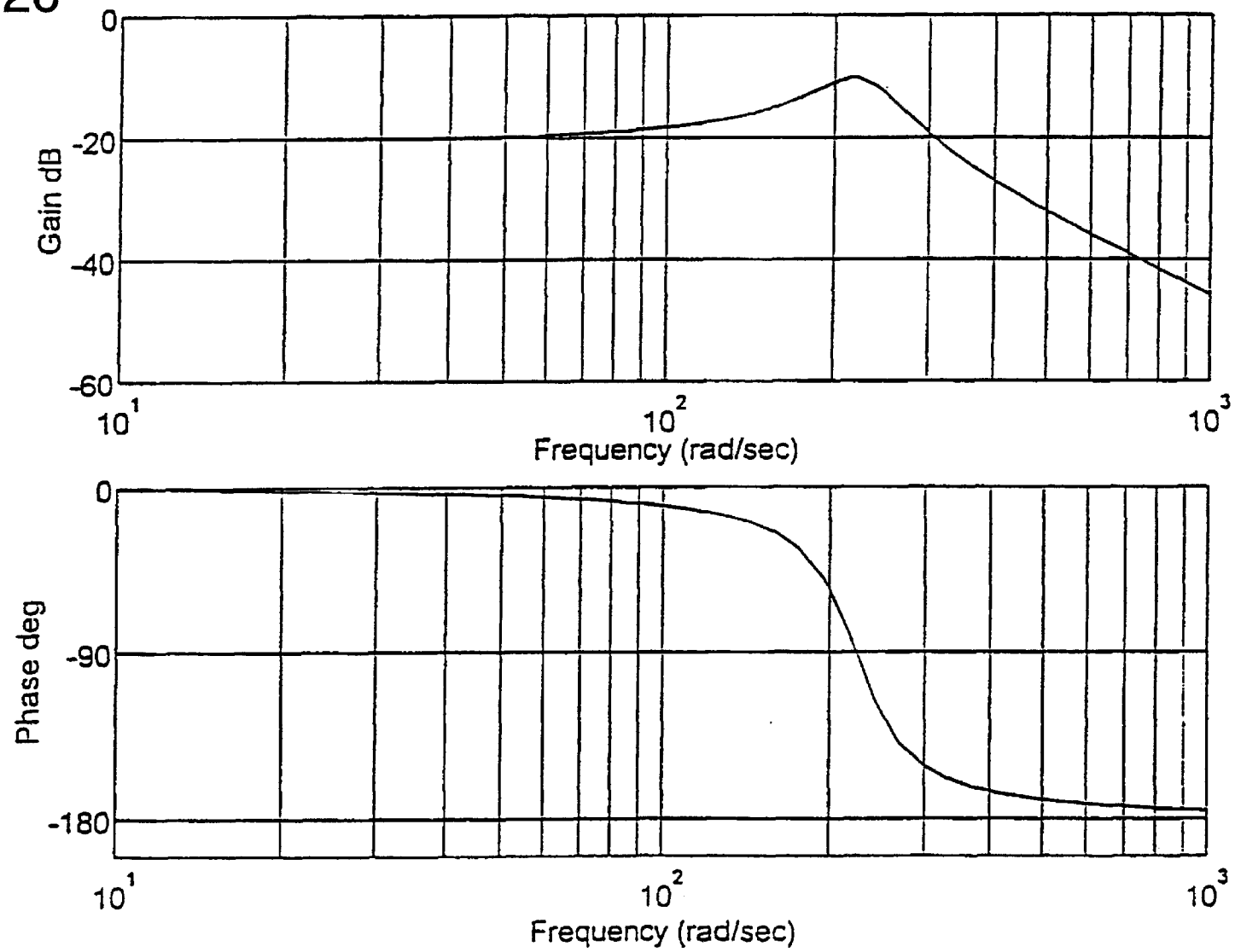
FIG. 26 is a graph showing the frequency response curve of the control valve; and, FIG. 27 is a graph showing the frequency response curve of the valve piston combination.
Figure 27:
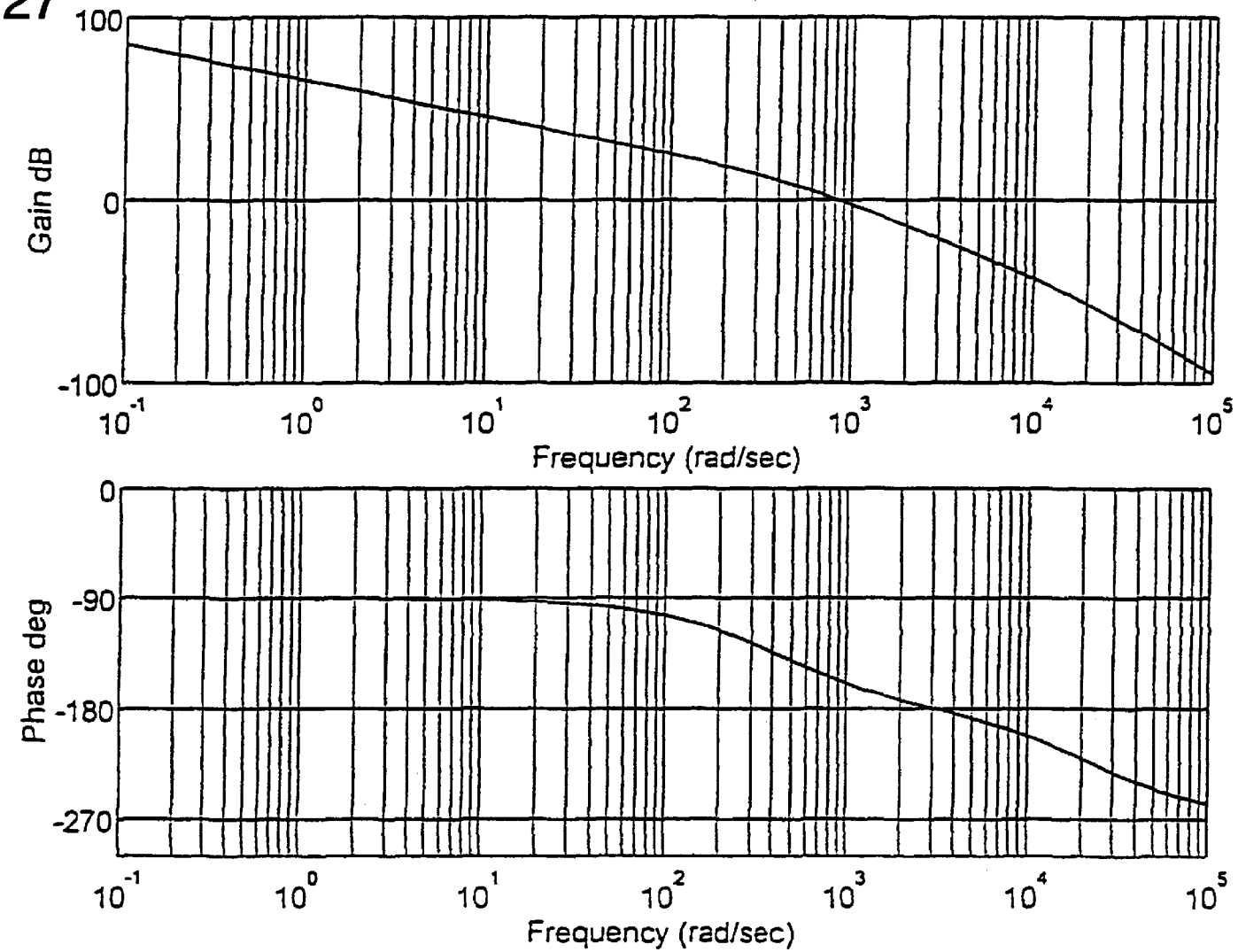

This transfer function is used to plot the frequency response curve (Bode diagram), as shown in FIG. 26. The natural frequency of the control system can be seen to occur at around 220 to 230 rad/sec.

Also, the transfer function for the valve piston combination is $$\frac{X_p}{X_v} = \frac{\frac{K_q}{A_p}}{s\left(\frac{s^2}{\omega_h^2} + \frac{2\delta_h}{\omega_h}s + 1\right)}$$

where $$\omega_h = \sqrt{\frac{4\beta_e A_p^2}{V_t M_t}}$$

and $$\delta_h = \frac{K_{ce}}{A_p}\sqrt{\frac{\beta_e M_t}{V_t}} + \frac{B_p}{4A_p}\sqrt{\frac{V_t}{\beta_e M_t}}$$

Several assumptions have to be made to simplify the calculation process. It is assumed that the piston is ideal, that is no internal or external leakage takes place. With this simplification $K_{ce}=K_c$, and $$K_c = C_d w x_v \frac{\sqrt{(1/\rho)(P_s - P_L)}}{2(P_s - P_L)}$$

The following parameter values can be substituted to get the hydraulic natural frequency, $\omega_h$, of this system, $A_p \approx 0.88$ in$^2$ $B_p \approx 2.13\times10^{-3}$ lb$_f$ sec/in $\beta_e \approx 100{,}000$ psi $C_d \approx 0.6$ $M_t \approx 0.011$ lb$_f$ sec$^2$/in $V_t \approx 2.923$ in$^3$ $\rho \approx 0.78\times10^{-4}$ lb/sec$^2$/in$^4$ $P_L \approx 50$ psi $P_s \approx 250$ psi $w \approx 1.76$ in $x_v \approx 0.04$ in $K_c \approx 0.169$ $K_q \approx 1690.95$ By substituting the above calculated parameter values into the transfer function we have $$\frac{X_p}{X_v} = \frac{1921.534}{s[(1.038\times10^{-7})s^2 + (2.4\times10^{-3})s + 1]}$$

Therefore the hydraulic natural frequency of the pump is approximately 3100 rad/sec. This value shows that the pump system is fast acting which is a desirable result. This result can be seen in FIG. 27, which shows the frequency response curve of this valve controlled pump. Thus, the pump and compensator combination is fast-acting in response to pressure deviations.

The pump, either alone or with the pressure compensator or control system, should find application in many fields. It is anticipated that the pump can be used to replace fixed displacement internal gear pumps. For example, the improved variable displacement gear pump could be advantageously deployed in agricultural equipment, including pressure spraying systems, hydraulic systems and the like, home pumping systems (for air, water and the like), etc. The environments for the pump are also widely varied in light of its durability and ruggedness as a result of its internal gear pumping method.

Whereas, the present invention has been described in relation to the drawings attached hereto, it should be understood that other and further modifications, apart from those shown or suggested herein, may be made within the spirit and scope of this invention.

NOMENCLATURE $A_1$ Area of larger end control valve spool
$A_2$ Area of smaller end of control valve spool
A Differential area of control valve spool (A—A)
$A_p$ Area of pump piston
$\alpha$ Viscous friction of load and piston
$B_p$ Viscous damping coefficient of piston
$B_e$ Effective bulk modulus of the fluid
B Port angle
C Pressure gradient of outer gerotor
$C_d$ Coefficient of discharge for orfice
$C_{ep}$ External leakage coefficient of piston
$C_{ip}$ Internal or cross-port leakage coefficient of piston
$C_{tp}$ Total leakage coefficient
c Damping constant
$\delta$ Damping factor
$\delta_h$ Damping ratio
e Exponential
$F_g$ Force generated or developed by piston
$K_3$ Load spring gradient
$K_{cc}$ Total flow pressure coefficient
$K_f$ Spring constant of trapped fluid in the piston chambers and fluid passages
$K_f$ Spring constant of trapped fluid in valve chambers and fluid passages
M Total mass of piston and load referred to piston
$M_v$ Mass of valve spool
$\omega_h$ Natural frequency of system
$\omega_n$ Hydraulic natural frequency
$P_1$ Change of control pressure of one side of piston
$P_2$ Change of control pressure on the other side of piston
$P_d$ Discharge pressure
$P_g$ Outer gerotor pressure
$P_i$ Intake pressure
$P_{sys}$ System pressure
$Q_1$ Flow through left piston chamber
$Q_2$ Flow through right piston chamber
$Q_L$ Flow through the load
$Q_s$ Supply flow
$\psi$ Phase angle of forced response
$\theta_g$ Outer gerotor angle
$V_1$ Volume of forward chamber
$V_{01}$ Initial volume of forward chamber
$V_2$ Volume of return chamber
$V_{02}$ Initial volume of return chamber
$V_t$ Total volume of fluid under compression in both chambers
$X_p$ Displacement of piston
$X_v$ Valve spool displacement from center position
W Area gradient
Y Increment of piston travel

REFERENCES:

Langreck, Gerald K., 1995 "Axially Ported Variable Volume Gerotor Pump Technology," U.S. Pat. No. 5,476,374, issued December 19.

Palmer, Walter E., 1978, "Variable Displacement Gear Pump," U.S. Pat. No. 4,097,204, issued June 27.

Specht, Victor J., 1985, "Variable Displacement Gerotor Pump," U.S. Pat. No. 4,492.539. Issued January 8.

Specht, Victor J., 1983, "Positionable Control Device for a Variable Delivery Pump," U.S. Pat. No. 4,413,960, issued November 8.

Tay, Y. F., 1997, "A Research Investigation of Pressure Compensated Variable Displacement Internal Gear Pumps," M.E. Thesis, University of Arkansas, Fayetteville, Ark., May.

What is claimed is:

1. In a pressurized fluid system including an internal gear pump for pumping fluids to maintain a desirable pressure in the system, the improvement comprising:

an improved internal gear pump including a hollow housing accepting fluids to be pumped and emitting pumped fluids at said desirable pressure;

a drive shaft penetrating said housing, said drive shaft rotating a gear of said internal gear pump to pump said fluids, said drive shaft having a longitudinal axis and said gear of said internal gear pump and said drive shaft being selectively axially displaceable along said longitudinal axis to vary the displacement of said pump; and, a pressure compensator integral with said housing and operatively associated with said drive shaft, said compensator adapted to vary the axial position of said gear of said internal gear pump on said longitudinal axis of said drive shaft to automatically maintain said pumped fluids at said desirable pressure.

2. The pressurized fluid system as recited in claim 1 wherein said internal gear pump further comprises an outer gerotor and port plug.

3. The pressurized fluid system as recited in claim 2 wherein said drive shaft further comprises an intermediate section with a reduced diameter upon which said gear is mounted.

4. The pressurized fluid system as recited in claim 3 wherein said drive shaft comprises a flange bordering the forward end of said intermediate section and a retainer sleeve bordering the rear end of section and wherein said gear is displaced between said flange and said sleeve.

5. In a pressurized fluid system including an internal gear pump for pumping fluids, the improvement comprising:

an improved internal gear pump including a hollow housing accepting fluids to be pumped and emitting pumped fluids at a desirable pressure;

a drive shaft penetrating said housing, said drive shaft rotating an internal gear of said internal gear pump to pump said fluids, said drive shaft having a longitudinal axis and said internal gear and said drive shaft being selectively axially displaceable along said longitudinal axis to vary the displacement of said pump;

an outer gerotor coaxial with said longitudinal axis and operatively associated with said internal gear, said outer gerotor adapted to facilitate the axial displacement of said internal gear;

a port plug having an external profile substantially the same as said outer gerotor to facilitate the displacement of said internal gear; and, a pressure compensator integral with said housing and operatively associated with said drive shaft, said compensator adapted to vary the axial position of said internal gear on said longitudinal axis of said drive shaft to automatically maintain said pumped fluids at said desirable pressure.

6. The pressurized fluid system as recited in claim 5 wherein said drive shaft further comprises an intermediate section with a reduced diameter upon which said internal gear is mounted.

7. The pressurized fluid system as recited in claim 6 wherein said drive shaft comprises a flange bordering the forward end of said intermediate section and a retainer sleeve bordering the rear end of section and wherein said internal gear is displaced between said flange and said sleeve.

* * * * *